United States Patent [19]

Brown

[11] Patent Number: 4,976,905

[45] Date of Patent: Dec. 11, 1990

[54] METHOD AND APPARATUS FOR MAKING WOOD PRODUCT

[76] Inventor: Gordon E. Brown, 196 W. 25th Ave., Eugene, Oreg. 97405

[21] Appl. No.: 430,572

[22] Filed: Nov. 1, 1989

[51] Int. Cl.[5] ..... B27N 3/22; B27N 3/12

[52] U.S. Cl. ..... 264/115; 264/119; 264/320; 425/80.1; 425/82.1; 425/338; 425/383; 425/412; 425/422

[58] Field of Search ..... 264/517, 518, 109, 119, 264/120, 121, 320, 115; 425/80.1, 82.1, 338, 339, 383, 406, 412, 422

[56] References Cited

U.S. PATENT DOCUMENTS

| | | | |
|---|---|---|---|
| 3,905,735 | 9/1975 | Thomas et al. | 425/256 |
| 3,914,079 | 10/1975 | Kober | 425/80.1 |
| 4,047,865 | 9/1977 | Axer et al. | 425/338 X |
| 4,212,616 | 7/1980 | Tilby | 425/256 |
| 4,573,899 | 3/1986 | Wiemann et al. | 425/145 |
| 4,649,006 | 3/1987 | Heggenstaller | 264/120 |

*Primary Examiner*—Mary Lynn Fertig Thiesen
*Attorney, Agent, or Firm*—Klarquist, Sparkman, Campbell, Leigh & Whinston

[57] ABSTRACT

A composite lumber product of consolidated comminuted wood and thermosetting resin made by a method which comprises densifying the material into a product-shaped heated metal mold by applying the compressing thrust in a direction parallel to the width dimension of the lumber-like article produced, rather than in the direction parallel the thickness dimension as in conventional hot platen pressing. Densifying in this manner produces much superior orientation of the wood grain along the long axis of the composite lumber product. The timed period elapsed during the densification to dimension now can be, and must be, quite short—of the order of twenty seconds or preferably less—allowing maximum heat transfer into the densified material from the hot metal broad-face (W×L) surface to thus minimize the presstime required. Apparatus for carrying out the method is disclosed.

11 Claims, 2 Drawing Sheets

METHOD AND APPARATUS FOR MAKING WOOD PRODUCT

This invention relates to a wood product of structural dimensions formed of comminuted wood and to processes and apparatus for forming such product.

BACKGROUND OF THE INVENTION

Ordinary lumber is a major article of commerce. It is of value because of a number of physical attributes, not the least of which is resistance to bending stress.

Resistance to bending stress is evaluated by a measurement known as Modulus of Rupture (MOR) which in turn depends upon (1) compressive strength in the area being compressed, i.e. the uppermost portion of cross-section in the middle of a horizontal, top-loaded, end-supported beam, (2) shear strength of the center area, top-to-bottom, of the top-loaded beam, and (3) most importantly, tensile strength of the lower, tensile-stressed mid-length area of the top-loaded, end-supported beam.

Resistance to bending stress in ordinary lumber is greatly affected, negatively, by natural defects such as knots, checks, wane, pitch pockets, etc. However, deficiency in MOR is the primary reason that consolidated comminuted woody products are not now a satisfactory substitute for lumber in the vast majority of lumber uses, notwithstanding the problems encountered in the use of natural wood lumber.

Another important physical property of lumber is its resistance to wear and abrasion, in turn also affected by defects, species, density, and growth rings.

Also important in certain use applications is resistance to deterioration in service due to exposure to mold, moss, insects and microorganisms. Lumber of some species, such as cedar, exhibit natural resistance but fall short in uses involving extreme exposure such as subterranean or marine contact. Consolidated comminuted wood can easily be fully treated with preservatives and attain uniform distribution.

And further, in end-use applications where fire-retardance of the article is important, retardants may be easily added to the comminuted wood furnish before consolidating, thus obviating the conventional autoclave pressure treatment of lumber with retardant solution then drying. The benign nontoxic nature of boric acid retardant cannot be used to impregnate lumber because of its low water solubility, but it can be added to particulate wood.

Composite lumber containing creosote preservative, that is suitable for laminating into articles (e.g. railroad ties) can accomplish objectives of both ecology and economy by using substantial percentages of recycled old ties whose creosote content prevents easy disposal. The old ties may be hammermilled and the particles metered into new resin-furnish and thereafter compressed and the resin cured. A product of high density is produced with much superior and long lasting spike-holding strength and plate-cut resistance. The absence of flaws, checks and knots prevents the incursion of water and rot to the interior and will give a much longer useful life than that of solid wood.

Another sometimes troubling shortcoming in the use of natural lumber is the occurrence of warping and/or checking, each due to uneven shrinkage upon drying along the radial growth ring direction compared to the circumferential direction. This effect is absent in consolidated articles.

Accordingly, it is an object of the invention to provide a process for economically producing wood products of structural lumber dimensions from comminuted wood.

More particularly, it is an object of the invention to provide wood products of structural lumber dimensions formed from comminuted wood and which products have physical characteristics sufficient to permit the products to be utilized in place of natural wood lumber.

Another object is to provide improved apparatus for forming structural lumber sized products from comminuted wood particles.

Other objects and advantages will become more apparent hereinafter.

SUMMARY OF THE INVENTION

The present invention consists of a method of and apparatus for combining comminuted wood particles into a hotpressed woody product so as to attain much of the physical bending strength of lumber while certain other valuable properties associated with lumber can be greatly enhanced.

The product of the invention has a long axis, length (L), a much smaller width dimension (W), and a still smaller thickness dimension (T), L being at least four times W and W being at least twice T. Most commonly envisaged products of the invention have dimensions roughly corresponding to joists, beams and framing lumber.

In accordance with the invention, woody raw material is comminuted to produce particles having a long axis paralleling the grain of the wood, a width axis, and a thickness axis in decreasing dimension L: W: T. This material is similar to the "wafer" and/or "strand" being used extensively in the panel building products industry at the present time.

The particles are coated with resin and thereafter dropped in long windrows from a felter onto a flat horizontal surface. Next, a series of moving rakes moves a desired number of windrows of particles on the flat surface into a movable "cold chamber".

The cold chamber consists of an envelope having top and bottom walls and end walls in the longitudinal direction and having a machine-direction depth dimension of more than twice the width dimension of product, and a thickness dimension (perpendicular to both the length axis and the machine direction) of approximately the eventual product thickness "T" dimension and a longitudinal dimension equal to the product length "L" dimension.

The cold chamber properly loaded with furnish is positioned in line with a hot chamber or mold and a thrust piston operated through the cold chamber to move the load of furnish and a lightly resisting baffle positioned between the piston and the furnish into the hot chamber, compressing the furnish load to approximate product dimension.

The hot chamber consists of a plurality of vertically spaced apart pairs of heated platens, the upper and lower platens each being aligned to define an extended horizontal chamber. Subsequent loads of furnish are fed into the hot chamber to advance previous loads toward the exit end. The baffles between loads are held in place between advancing steps by retractable dogs.

It is a key requirement of this hotpressing method, wherein the compressing thrust is perpendicular to the product thickness axis "T" (and the product edge surface), that the compressing of a load in the hot chamber be essentially complete within a time period of about twenty seconds maximum, preferably under ten seconds. This need has remained unrecognized by other investigators.

The broad faces of the product (W×L) are the primary avenue of heat transfer to the article from the abutting metal platens of the hot chamber, which are heated to about 330°–420° F. The prospect of premature setting of the binder at and near the metal-wood interface necessitates very rapid consolidation to dimension which takes place laterally across the plane of the interface, to avoid detrimental tardy consolidation of the already set surface area.

In conventional hotpressing of comminuted wood furnish to produce articles, principally panels having two large and one quite small dimensions, the heated metal platen involved in the transfer of heat to the product moves to consolidate the article, exerting thrust and pressure in a direction that is perpendicular to the broad face, both L and W axes.

In this conventional procedure, an important consideration is the magnitude of the time period in which the consolidation is brought about. Since the broad surfaces are the first to be heated they are prone to consolidate early in the pressing cycle to a higher density than inner material farther from the heat source. Moisture and heat move toward the thickness center, complicating the balance of densifying influences, while points near the surfaces begin to reflect binder setting so as to resist further densification. All of these variables require a compromise in the selection of a time period for consolidation in order to get the most acceptable desired density uniformity across the thickness cross section, and to avoid surface precure.

For three-quarter inch board, press close times are typically from forty to sixty-five seconds. For one inch and thicker boards, compromise consolidation times necessarily become too long to produce good board properties because surfaces precure before consolidation and centers do not get enough heat soon enough through the extra thickness of low density, lower heat conductive material that persists for a large portion of the press period.

And in broad platen heating/compressing, the tendency of the board to delaminate at the thickness centerline with marginal press times is drastically aggravated by the almost perfect orientation of the particle surfaces perpendicular to the direction of thrust of consolidating pressure, presenting a plane of cleavage parallel the heating surface exactly at the weakest, last-to-cure point in the board. Observe that the particle mat is virtually always felted with a gravity drop, orienting the particle in a horizontal plane perpendicular to the direction of gravity, before pressing with thrust also paralleling gravity, thus accentuating the horizontal plane of cleavage.

In contrast, my method starts to conduct heat to the board interior quickly because of the very rapid consolidation to density. It is commonly known that low density is associated with insulating; high density with heat conductivity. Early curing next to the heated metal only tends to hold the whole piece stable against springback at the time pressure is released. Further, there is no plane of cleavage midway between the heated metal surfaces, due to the different direction of compression. Thickness springback is minimal and nonweakening to the board. Some springback is beneficial to the extent it may reduce moisture-induced thickness swell in service.

Because of the above enumerated distinctions between my method and conventional broad-platen heating/compressing, I find it feasible to prepare substantially thicker articles, such as the one and one-half inches thickness of nominal two-inch lumber, with substantially superior strength properties, and at substantially diminished press times.

Nonetheless, minimizing press time requirement remains a desirable goal, and I prefer to utilize fast-curing phenolic resins such as that in claim 1 of my U.S. Pat. No. 4,373,062, or, alternatively, an on-site mixture of that phenolic resin with the phenol-resorcinol-formaldehyde resin of that same patent, or, alternatively, an acid-catalyzed aqueous phenolic resin catalyzed on site.

Maximum and minimum limiting parameters of dimensions, densities, resin content, etc., are largely not pertinent to this invention because they are self-limiting. For example, minimum thickness (possibly one-half inch) is due to the diminishing advantage of this method in thinner products over broad platen compressing as to the importance of MOR and the cost of manufacturing. Maximum thickness (possibly three inches), again, is determined by the economic factors balancing much longer press times against the cost of laminating, say, one and one-half inches thickness to three inches or more.

Width and length limitations are functions of production equipment cost versus specific market demand.

Densities and resin content levels are measures of product cost and product use value, and are economically determined factors. This is also true of the addition of preservatives, fire retardants or water repellants.

For a further description of the invention reference is made to the accompanying drawings and the detailed description of the invention.

DETAILED DESCRIPTION OF THE INVENTION

Figure 1:
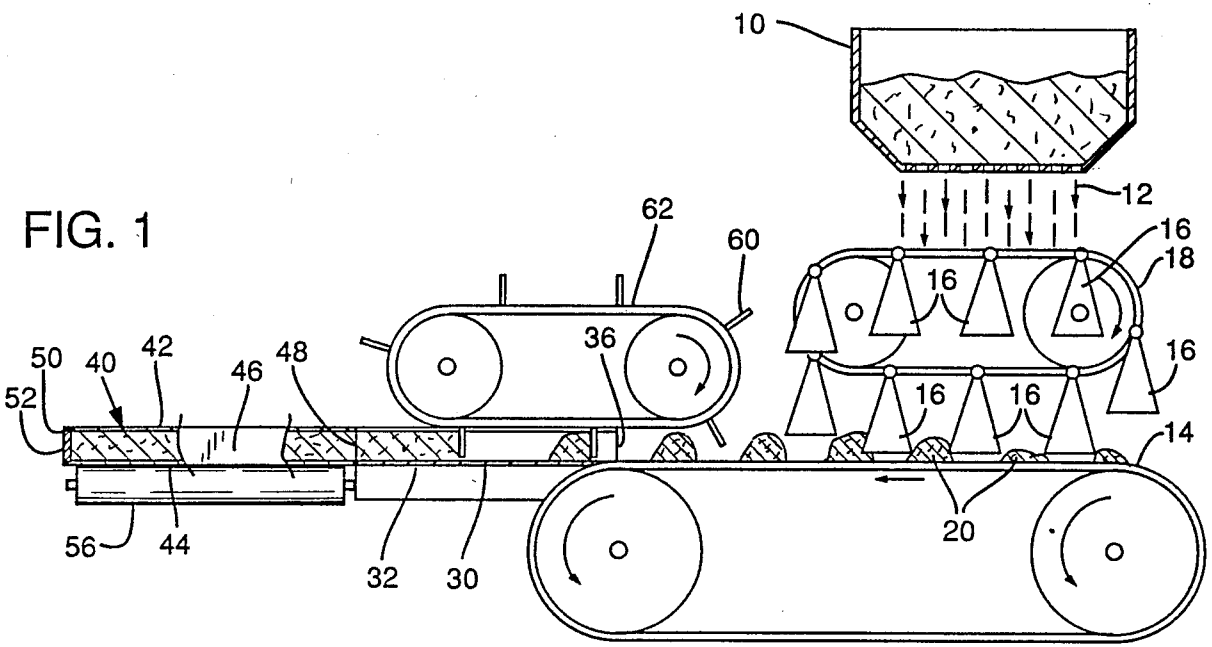
FIG. 1 is a schematic side elevation of apparatus for measuring out desired amounts of resin-coated comminuted wood particles and positioning desired amounts thereof into cold chambers.

The lumber-like product of the invention is prepared with common woody raw material preferably comprised of flakes or particles having a long axis in the direction of the wood grain, a width perpendicular to and less than half the magnitude of the particle length, and a third axis of thickness perpendicular to the other two axes, the thickness dimension being five percent or less of the long axis. The preferred dimensions of such particles is a length of between two and three inches, a width of between one-quarter and one-half inch, and a thickness of between 0.040 and 0.060 inch.

Particles to be formed into the product of the invention are coated with a thermosetting resin in any suitable apparatus. Thereafter, the coated particles are arranged for loading into a suitable press with the particles arranged so that their long axes are parallel and when loaded into the press to form the desired board will be parallel to the long axis of the completed board. This can be done in accordance with the apparatus of the invention by placing the resin coated particles in a felter 10 from which they are allowed to feed at a controlled rate in a rain of particles 12 downwardly upon the upper run of a belt conveyor 14 which is driven in a counterclockwise direction, as viewed in FIG. 1 and as shown by the arrows adjacent the conveyor belt. The particles 12 are fed onto the conveyor 14 through a series of elongated baffles 16 which extend transversely of the conveyor belt 14 and which are hingedly suspended from a plurality of cables 18 driven in the clockwise direction as viewed in FIG. 1. The cables 18 and the conveyor 14 travel at the same linear speed with the lower course of the baffles adjacent the surface of the conveyor whereby the particles fall onto the conveyor 14 in a series of cross-machine windrows 20 which are of length substantially equal to the length of the product to be formed. Mounted at the discharge end of the belt 14 is an antechamber 30 which is of rectangular cross section, the bottom wall 32 being solid as are the opposite side walls, the top wall having longitudinal slots 34 therein parallel to the direction of motion of the cables 18 for a purpose to be explained. The end 36 of the antechamber 30 adjacent the discharge end of the conveyor 14 is open to receive the windrows of furnish as the belt carries them to such end. The opposite end 38 of the antechamber 30 is open so that furnish can be passed therethrough and into one of a series of cold chambers 40 that are brought into juxtaposition with the antechamber one-by-one. The movable cold chambers have solid top and bottom walls 42, 44, respectively, and opposite solid end walls, such as wall 46 visible in FIG. 1. The side 48 adjacent the end of the antechamber is open as is the opposite side 50, but the side 50 is adapted to receive a baffle 52 during the loading sequence removably held in place by detents on the top and bottom walls of the cold chamber, or by other suitable means. As indicated previously, the cold chamber has a length between the end wall 46 and the opposite end wall substantially equal to the desired length of the product to be formed, and the height of the chamber between the top and bottom walls 44, 42 is substantially equal to the thickness dimension of the product. However, the distance between the sides 48, 50 of the cold chamber is preferably at least twice the dimension of the width of the product to be formed.

Suitable means are provided to support a cold chamber 40 adjacent the antechamber 30. In the illustrated embodiment, such means comprises a belt conveyor 56 which is arranged at right angles to the belt conveyor 14 and is adapted to be driven intermittently by suitable means (not shown) so as to move the cold chamber 40 into juxtaposition with the antechamber 30, and, after loading, to move it to a further position to be described.

Means are provided to crowd the windrows 20 through the antechamber 30 and into a cold chamber 40. Such means comprises a plurality of rake tines 60 extending substantially rigidly from a flexible belt 62 driven counterclockwise as shown in FIG. 1. The rakes 60 are driven at a faster linear speed than the conveyor 14 and are timed so that sets thereof engage between windrows 20 and to move the engaged windrow toward and into the antechamber 30. The slots 34 in the antechamber are adapted to receive the individual rake tines 60 so that the rake tines may move through the antechamber, crowding windrows of particles into and through the antechamber and into a cold chamber 40 aligned therewith.

Figure 2:
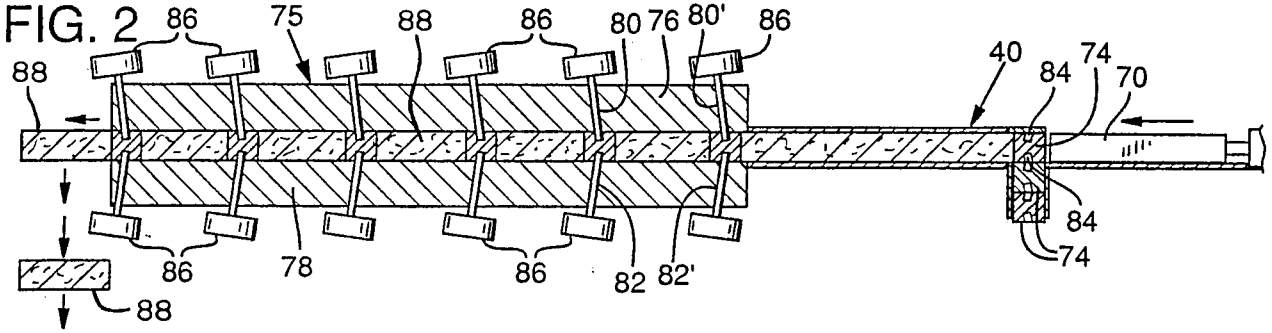
FIG. 2 is a schematic, cross-sectional view of apparatus for compacting the wood particles and heat setting the compacted particles into finished boards.
Figure 3:
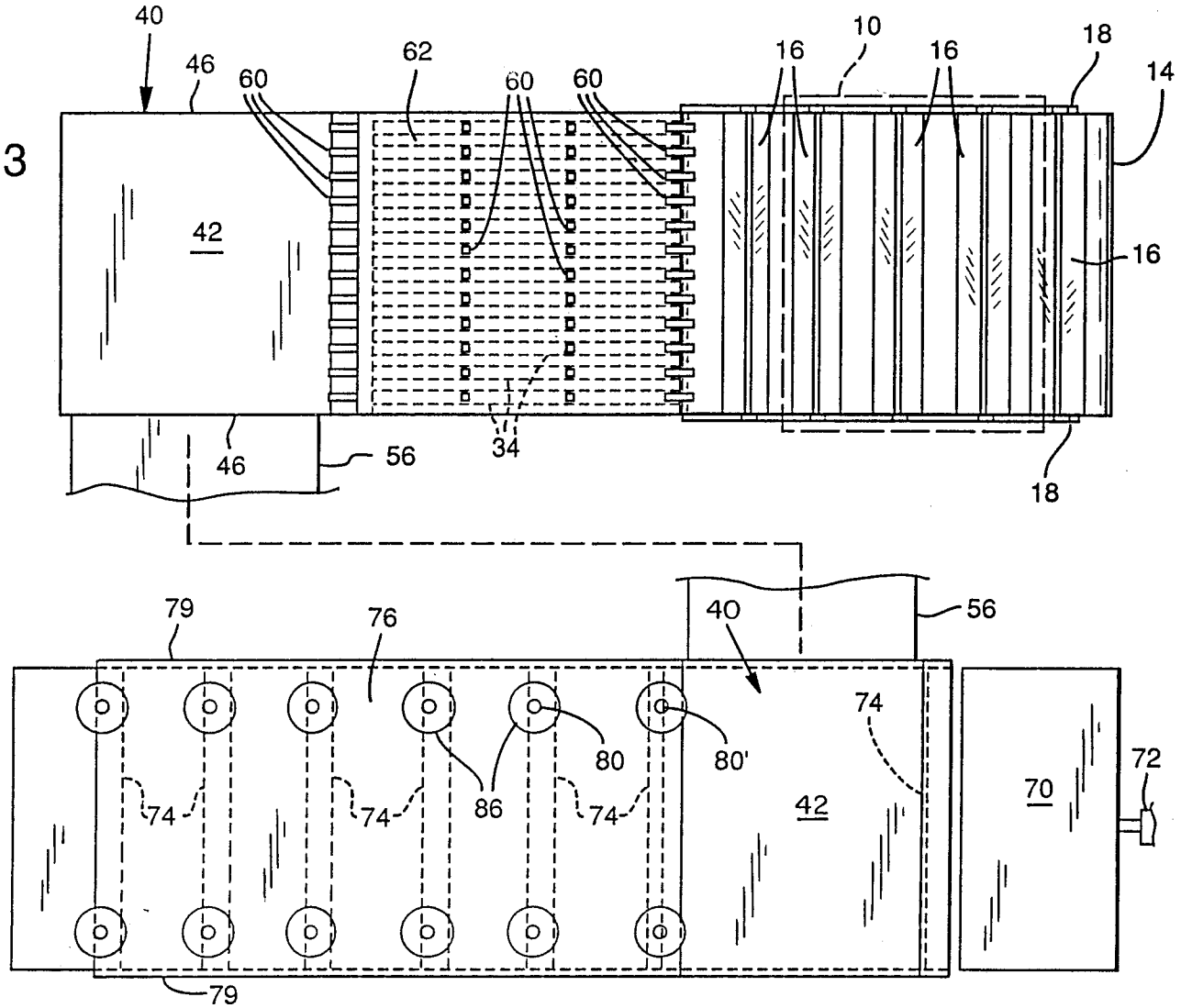
FIG. 3 is a top schematic view of the apparatus of FIGS. 1 and 2.

When a cold chamber 40 has been filled with the desired amount of furnish, the conveyor 56 is indexed to move the filled cold chamber horizontally and to move an empty cold chamber 40 into position adjacent the end of the antechamber 30 to receive a load of particles. Referring to FIGS. 2 and 3, the filled cold chamber is moved by the conveyor 56 into alignment with a rectangular ram 70 having dimensions that can slide snugly within and through a cold chamber 40. The ram is driven by suitable means such as an hydraulic cylinder indicated at 72 so that it can be reciprocated into and through a cold chamber and thereafter withdrawn. As a cold chamber 40 is aligned with the withdrawn ram 70 a metal spacer 74 in the form of an elongated rectangular block is positioned adjacent the entry end of the cold chamber for engagement by the ram 70 as it advances toward and into the cold chamber and the baffle 52 is removed. Aligned with the discharge end of the cold chamber is an elongate hot chamber or mold 75 comprising a series of upper heated platens 76 and lower heated platens 78 which are spaced apart a distance equal to the desired thickness of the finished product. The platens 76, 78 are rigidly mounted by suitable means (not shown) so as to remain in position during transit of the compressed furnish therebetween. Extending the length of the mold 75 at each side thereof are side walls 79 which are spaced apart a distance equal to the length of the desired product. Between each adjacent pair of platens are upper and lower dogs 80, 82, respectively, which are adapted to engage within cooperative slots 84 formed in the spacers 74. Means are provided for retracting the dogs 80 from the spacers 74 simultaneously, except for the dogs 80', 82' most closely adjacent the entry end of the mold. Such means are indicated at 86 and may comprise any suitable mode or system, such as ratchet and pinion, or the like. The dogs 80', 82' have a slightly different sequence of operation than the other dogs as will be explained.

The cycling of the ram 70 and the dogs 80', 82' is as follows. When a cold chamber 40 is positioned in line with the mold 75 the baffle 52 is removed from the end 50 of the cold chamber, a spacer 74 is positioned at the entry end 48 of the chamber and the dogs 80, 82 and 80', 82' are retracted. The ram 70 is then advanced to apply pressure to the spacer 74 and commence compacting the particle load within the cold chamber. This pressure will cause the previously compacted and consolidated boards 88 within the mold 75 to start moving toward the discharge end thereof. As the spacer, which at the commencement of the cycle was between and held by the dogs 80', 82', reaches the next set of dogs 80, 82, such dogs are advanced to engage such spacer, and all of the dogs towards the discharge end of the curing chamber likewise advance to engage the spacers that are spaced between the pairs of dogs. However, the dogs 80', 82' are not advanced at that point but are held upwardly until the ram 70 completes the compaction of the load of particles in the cold chamber 40 and moves the spacer 74 which was originally at the entry end of the cold chamber into alignment with the dogs 80', 82'. Preferably the ram 70 first advances within the mold 75 to compact the particles to between ninety and ninety-eight percent of the desired product width within ten to twenty seconds and is thereafter retracted to position the spacers 74 opposite the dogs 80', 82'. At that time, the dogs 80', 82' are moved into their locking position to hold such spacer in position. The over compaction will reduce the swelling of the width dimension of the finished product while in service. Thereafter the ram 70 is withdrawn to its starting position, the empty cold chamber 40 removed and a filled cold chamber moved into place opposite the ram to be in position for restart of the cycle.

In accordance with the invention, the stroke of the ram should be at such rate as to attain compaction of the cold press load within the curing oven and should be such that the compression takes place within twenty seconds and preferably within ten seconds. The length of the curing oven should be such that the transit time of a charge through the oven is sufficient to complete cure of the resin used. For my preferred resin a transit time of about three and one-half minutes will provide sufficient for a complete cure of the resin.

The comminuted particles or wafers preferably have a length between two and three inches and a width of between one-quarter and one-half inch and a thickness of between 0.040 and 0.060 inch.

There are numerous thermosetting resins which will be adaptable to utilization in this process. A preferred resin is the fast curing phenolic resin such as described in my U.S. Pat. No. 4,373,062. Alternatively, an on-site mixture of such a phenolic resin with a phenol-resorcinol-formaldehyde resin such as that of the same patent, might be used, or an acid-catalyzed aqueous phenolic resin catalyzed on site could be utilized. Preservatives, retardants or water repellants could also be applied to the particles. A suitable resin content would be between six to seven percent solids by weight based on the bone dry fiber content of the particles. The resin-coated particles also preferably have a moisture count of between nine and eleven percent based on the bone dry fiber weight.

The process of the invention is particularly adapted for forming boards of the conventional framing size, namely, so-called 2×4s, 2×6s, 2×8s, 2×10s and 2×12s, all of which have a nominal thickness of one and one-half inches and a width from three and five-eighths to eleven inches. However, boards down to one-half inch thickness are possible as are boards up to about three inches in thickness.

EXAMPLE 1

An attempt was made to produce a sample board for testing of the composite lumber product of this invention, but the equipment utilized had inadequate compressing thrust to permit consolidation to the desired density. As a result, a board of only 0.375 specific gravity instead of the intended 0.750 was produced. The board produced was three-quarter inch thick, about five inches wide and twelve inches long. It was formed of Douglas fir strand particles having a length of between one and one and one-half inches, a width up to one-quarter inch and a thickness of about one-eighth inch. These particles were coated with seven percent of phenolic resin (based on bone dry fiber basis) as set forth in claim 1 of my U.S. Pat. No. 4,373,062. The particle/resin combination had a moisture content of 9.7 percent on a bone dry fiber basis prior to consolidation.

The particles were aligned lengthwise of their grain and subjected to pressure transversely of their length under platens heated to 350° F. The consolidating movement of the press platen sharply diminished at twenty seconds of press time and ceased completely before sixty seconds had elapsed. The pressure was maintained for approximately five minutes and then released. The resulting board had a specific gravity of only 0.375 instead of the intended 0.750. Nonetheless the modulus of rupture of the pressed board trimmed to five inches by ten inches, was a respectable 2790 psi long axis. This is remarkable in the light of the general rule with sharply rising curve graphing MOR versus Sp.G. over the range of Sp.G. 0.375 to 0.750.

EXAMPLE 2

This example illustrates the compression resistance of various woody materials and the correlation of that resistance with the density of the material. In considering end-use purposes cited in the "Background of the Invention" herein involving crushing, impact and abrasion resistance, it will be noted that densities of consolidated wood articles can be made to range much higher than the respective constituent wood.

Various wood particleboards which I made and various species and densities of lumber were tested by applying an increasing load to a 0.500 inch steel ball in contact with the surface of the woody material being tested. The load in pounds was recorded at the point the 0.500 inch ball was imbedded to a depth of 0.250 inch in the subject material. The results are set out in Table 1.

TABLE 1

| Description | Density, g/cc | Lbs. to 0.250 inch |
|---|---|---|
| Ponderosa pine lumber | 0.460 | 534 |
| Douglas fir lumber | 0.423 | 471 |
| Douglas fir lumber | 0.633 | 1068 |
| White oak lumber | 0.782 | 1193 |
| Particleboard Douglas fir | 0.77 | 1507 |
| Particleboard Douglas fir* | 0.81 | 1633 |
| Particleboard Douglas fir* | 0.87 | 1821 |
| Particleboard Douglas fir | 0.97 | 3913 |

*Contained recycled, creosote-containing comminuted wood.

Having illustrated and described a preferred embodiment of my invention it will be apparent to others that the invention permits of changes in arrangement and detail. I claim all such changes as come within the scope and purview of the following claims.

I claim:

1. The process of preparing a composite lumber-like product comprising consolidated comminuted wood and thermosetting resin, which process comprises:

comminuting a woody raw material so as to produce particles having a length axis paralleling the grain of the wood, a width axis and a thickness axis, all in substantially decreasing ratio of dimension L:W:T;

coating the particles with a thermosetting resin;

felting the particles into a mat having a length equal to the length dimension of said lumber-like product, the felted mat depth corresponding approximately to the thickness dimension of said product, and a width such that upon compaction to the width dimension of said product the product will have a predetermined density; and compacting such mat in a heated mold having fixed longitudinal end and top and bottom walls to applying an opposed constraining means or compressing thrust in a direction parallel to said width dimension of the product;

completing said compacting to said width dimension within a time period of twenty seconds or less, and effecting cure of the thermosetting resin in said mold and thereafter ejecting the formed lumber-like board.

2. The process of claim 1 wherein the time period is less than ten seconds.

3. The process of claim 1 wherein the initial mat of particles is compressed within a twenty second period to a width of from ninety to ninety-eight percent of that of the said width dimension; and thereafter the constraining means in the width direction is withdrawn to said width dimension of the product during the ensuing resin-curing period to allow gradual springback of the solidifying mat to the intended width dimension, thereby effecting improved in-use dimensional stability in the product.

4. The process of claim 1 wherein the material being felted is allowed to fall on elongate parallel angled baffles and thereafter to fall upon a horizontal surface, said baffles deflecting material into parallel windrows on said surface with intervening spaces;

crowding the windrows together into a plenum so as to form a low density charge of contiguous material in said plenum, against light reverse restraint to minimize loss of orientation and keep the charge contiguous.

5. Apparatus for forming a lumber-like product from comminuted wood particles coated with a thermosetting resin comprising, a first horizontal conveyor, having an upper run driven in a first direction, parallel, elongate means for depositing windrows of said coated particle upon said first conveyor with the long axis of each of said windrows perpendicular to said first direction, means defining an open-sided antechamber positioned at the discharge end of said first conveyor, means for sweeping windrows of particles from the discharge end of said first conveyor into said antechamber through one side thereof as the particles are conveyed thereto, means defining a plurality of cold chambers each comprising an elongate box having top, bottom and end walls and being open at each side, said box having a length substantially equal to the length of said windrows, means for positioning an empty cold chamber in juxtaposition with said antechamber whereby said particles may be moved through said antechamber and into said juxtaposed cold chamber, a mold comprising a plurality of opposed upper and lower heated platens, means for moving a particle filled cold chamber from its position adjacent said antechamber to a position in juxtaposition with said mold, and ram means for compacting the load of particles in a cold chamber juxtaposed with said mold and simultaneously moving said load of particles into said mold, and means for ejecting a load of particles from said mold after a predetermined period of time.

6. Apparatus as set forth in claim 5 wherein between adjacent pairs of platens are mounted dogs adapted to be extended into and retracted from the space between said upper and lower platens, and a plurality of spacers positioned one between each charge of particles positioned in said mold, said spacers being formed to engage said dogs when the latter are extended into said space, said spacers being slidable within said mold upon retraction of said dogs and application of compaction force by said means, and means for extending and retracting said dogs.

7. Apparatus as set forth in claim 5 wherein said ram means is capable of effecting its compaction stroke within twenty seconds.

8. Apparatus as set forth in claim 5 wherein said ram means is capable of completing its compaction stroke within ten seconds.

9. Apparatus as set forth in claim 6 wherein the means for extending and retracting said dogs effects simultaneous retraction of all of said dogs whereby the movement of a fresh load of particles into said mold effects movement of all prior loads toward the discharge end of said mold and said means for extending and retracting said dogs effects simultaneous extension of all of said dogs except those next adjacent the entrance end of mold, said means for extending said dogs causing said last mentioned dogs to be extended a peredetermined period of time after the other dogs are extended.

10. Apparatus as set forth in claim 5 wherein said antechamber comprises a top wall having a plurality of slots therein parallel to said first direction and said means for sweeping windrows comprises a plurality of rakes having tines adapted to engage said windrows and slide through said slots, and means for propelling said tines in said first direction.

11. Apparatus as set forth in claim 5 wherein said means for positioning a cold chamber in juxtaposition with said antechamber and said means for moving a particle filled cold chamber comprises a second horizontal conveyor having an upper run driven in a second direction perpendicular to said first direction.

* * * * *

UNITED STATES PATENT AND TRADEMARK OFFICE

CERTIFICATE OF CORRECTION

PATENT NO. : 4,976,905

DATED : December 11, 1990

INVENTOR(S) : Gordon E. Brown

It is certified that error appears in the above-identified patent and that said Letters Patent is hereby corrected as shown below:

TITLE PAGE:

In the Inventor information line [76], "196" should be --1960--;

Column 8, line 63, "walls to applying" should be --walls by applying--.

Signed and Sealed this

Thirteenth Day of April, 1993

*Attest:*

STEPHEN G. KUNIN

*Attesting Officer*

*Acting Commissioner of Patents and Trademarks*